US008477166B2

(12) United States Patent
Morooka et al.

(10) Patent No.: US 8,477,166 B2
(45) Date of Patent: Jul. 2, 2013

(54) THERMAL HEAD, THERMAL PRINTER AND MANUFACTURING METHOD FOR THE THERMAL HEAD

(75) Inventors: Toshimitsu Morooka, Chiba (JP); Keitaro Koroishi, Chiba (JP); Noriyoshi Shoji, Chiba (JP); Norimitsu Sanbongi, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 13/136,005

(22) Filed: Jul. 20, 2011

(65) Prior Publication Data

US 2012/0050447 A1 Mar. 1, 2012

(30) Foreign Application Priority Data

Aug. 25, 2010 (JP) ..... 2010-188155

(51) Int. Cl.
*B41J 2/335* (2006.01)

(52) U.S. Cl.
USPC ..... 347/208; 347/200

(58) Field of Classification Search
USPC ..... 347/200, 208
See application file for complete search history.

(56) References Cited

U.S. PATENT DOCUMENTS 4,907,015 A * 3/1990 Kaneko et al. ..... 347/204
5,272,489 A * 12/1993 Kobayashi et al. ..... 347/206
5,594,488 A * 1/1997 Tsushima et al. ..... 347/208
6,501,497 B2 * 12/2002 Shirakawa et al. ..... 347/208
7,768,541 B2 * 8/2010 Koroishi et al. ..... 347/202
2002/0024582 A1 * 2/2002 Shirakawa et al. ..... 347/208
2002/0044193 A1 * 4/2002 Sambongi ..... 347/208
2010/0134581 A1 6/2010 Koroishi et al. ..... 347/200

FOREIGN PATENT DOCUMENTS

EP 2179850 4/2010
EP 2327554 6/2011
JP 2009119850 6/2009

OTHER PUBLICATIONS

Computer-generated translation of JP 2009-119850, published on Jun. 2009.*

* cited by examiner

*Primary Examiner* — Huan Tran
(74) *Attorney, Agent, or Firm* — Adams & Wilks

(57) ABSTRACT

A thermal head comprises a first substrate having a concave portion, a second substrate mounted on the first substrate and covering the concave portion to form with the first substrate a cavity portion, a heating resistor provided on a surface of the second substrate, and a pair of electrodes connected to the heating resistor for supplying power to the heating resistor. At least one of the pair of electrodes has a low thermal conductivity portion in a region opposed to the cavity portion. The low thermal conductivity portion is made of a material having a thermal conductivity lower than a thermal conductivity in other regions of the pair of electrodes and having an electrical resistance lower than an electrical resistance of the heating resistor.

18 Claims, 11 Drawing Sheets

THERMAL HEAD, THERMAL PRINTER AND MANUFACTURING METHOD FOR THE THERMAL HEAD

BACKGROUND OF THE INVENTION

1. Field of the Invention

The present invention relates to a thermal head, a thermal printer, and a manufacturing method for the thermal head.

2. Description of the Related Art

There has been conventionally known a thermal head for use in thermal printers (see, for example, Japanese Patent Application Laid-open No. 2009-119850). In the thermal head described in Japanese Patent Application Laid-open No. 2009-119850, a plurality of heating resistors are formed on a stacked substrate of a support substrate and an upper substrate, and power is supplied to pairs of electrodes connected to the heating resistors, thereby allowing the heating resistors to generate heat to perform printing on a thermal recording medium or the like.

In the thermal head, a cavity portion is formed at a position opposed to each of the heating resistors in a bonding portion between the support substrate and the upper substrate. The cavity portion functions as a heat insulating layer of low thermal conductivity to reduce an amount of heat to be transferred from the heating resistor toward the support substrate via the upper substrate, to thereby increase thermal efficiency and reduce power consumption.

Further, in the commonly-used thermal head, in order to supply the heating resistor with sufficient power from an external power source, the electrodes are designed in consideration of the electrical resistance from external input terminals to the heating resistor. As the ratio of the electrical resistance of the electrode to the electrical resistance of the heating resistor becomes larger, a larger power loss occurs by voltage drop of the electrical resistance from the external input terminals to the heating resistor. It is therefore necessary to decrease the electrical resistance of the electrode. The electrical resistance of the electrode can be decreased by thickening the electrode.

However, heat generated by the heating resistor diffuses also in the planar direction of the upper substrate via the electrodes. Further, when the electrode is thickened, the thermal conductivity of the electrode is increased. Therefore, the conventional thermal head has a problem that the heat insulating performance provided by the cavity portion cannot be fully utilized because the heat dissipates from the heating resistor in the planar direction of the upper substrate via the electrodes.

SUMMARY OF THE INVENTION

The present invention has been made in view of the above-mentioned circumstances, and it is therefore an object of the present invention to provide a thermal head which is capable of suppressing diffusion of heat from a heating resistor in a planar direction of an upper substrate via electrodes so that the printing efficiency may be increased, and to provide a printer including the thermal head. Further, it is another object of the present invention to provide a method of manufacturing the thermal head with ease.

In order to achieve the above-mentioned objects, the present invention provides the following measures.

The present invention provides a thermal head including: a stacked substrate including a flat plate-shaped support substrate and a flat plate-shaped upper substrate which are bonded to each other in a stacked state; a heating resistor formed on a surface of the flat plate-shaped upper substrate; and a pair of electrodes connected to both ends of the heating resistor, respectively, for supplying power to the heating resistor, in which the stacked substrate includes a cavity portion in a region opposed to the heating resistor at a bonding portion between the flat plate-shaped support substrate and the flat plate-shaped upper substrate, and at least one of the pair of electrodes includes a thin portion in a region opposed to the cavity portion, the thin portion being thinner than other regions of the pair of electrodes.

According to the present invention, the upper substrate disposed directly under the heating resistor functions as a heat storage layer that stores heat, whereas the cavity portion formed in the region opposed to the heating resistor functions as a hollow heat insulating layer that blocks the heat. Because of the formation of the cavity portion, among an amount of heat generated by the heating resistor, an amount of heat transferring toward the support substrate via the upper substrate can be reduced.

In this case, the heat generated by the heating resistor diffuses also in the planar direction of the upper substrate via the electrodes. In the thermal head according to the present invention, the thin portion of at least one of the electrodes, which is disposed above the cavity portion, has thermal conductivity lower than other regions of the electrodes. Therefore, the heat generated from the heating resistor can be prevented from easily transferring to the outside of the region opposed to the cavity portion. This suppresses the diffusion of the heat, which is prevented by the cavity portion from transferring toward the support substrate, in the planar direction of the upper substrate via the electrodes. Therefore, the heat can be transferred to an opposite side of the support substrate to increase printing efficiency.

In the above-mentioned invention, the thin portion may extend to an outside of the region opposed to the cavity portion.

With such a structure, the region of low thermal conductivity of the electrode extends to the outside of the region opposed to the cavity portion. Accordingly, the diffusion of heat from the heating resistor in the planar direction of the upper substrate via the electrodes can be suppressed more. Therefore, high heat insulating performance exerted by the cavity portion can be fully utilized.

Further, in the above-mentioned invention, both of the pair of electrodes may include the thin portions.

With such a structure, in any of the electrodes, the heat generated from the heating resistor can be prevented from easily transferring to the outside of the region opposed to the cavity portion. Therefore, the diffusion of heat in the planar direction of the upper substrate via the electrodes can be suppressed more effectively.

The present invention provides a thermal head including: a stacked substrate including a flat plate-shaped support substrate and a flat plate-shaped upper substrate which are bonded to each other in a stacked state; a rectangular-shaped heating resistor formed on a surface of the flat plate-shaped upper substrate; and a pair of electrodes connected to both ends of the rectangular-shaped heating resistor, respectively, for supplying power to the rectangular-shaped heating resistor, in which the stacked substrate includes a cavity portion in a region opposed to the rectangular-shaped heating resistor at a bonding portion between the flat plate-shaped support substrate and the flat plate-shaped upper substrate, and at least one of the pair of electrodes includes a low thermal conductivity portion in a region opposed to the cavity portion, the low thermal conductivity portion being made of a material having thermal conductivity lower than other regions of the pair of electrodes and having an electrical resistance lower than an electrical resistance of the rectangular-shaped heating resistor.

According to the present invention, the low thermal conductivity portion of at least one of the electrodes, which is disposed above the cavity portion, has an electrical resistance lower than that of the heating resistor. Accordingly, sufficient power can be supplied to the heating resistor. Further, the thermal conductivity of the low thermal conductivity portion is lower than the other regions of the electrodes, and hence the heat generated from the heating resistor can be prevented from easily transferring to the outside of the region opposed to the cavity portion. This suppresses the diffusion of the heat, which is prevented by the cavity portion from transferring toward the support substrate, in the planar direction of the upper substrate via the electrodes. Therefore, the heat can be transferred to an opposite side of the support substrate to increase printing efficiency.

Further, in the above-mentioned invention, the low thermal conductivity portion may extend to an outside of the region opposed to the cavity portion.

The region of low thermal conductivity of the electrode extends to the outside of the region opposed to the cavity portion. Accordingly, the diffusion of heat from the heating resistor in the planar direction of the upper substrate via the electrodes can be suppressed more. Therefore, high heat insulating performance exerted by the cavity portion can be fully utilized.

Further, in the above-mentioned invention, both of the pair of electrodes may include the low thermal conductivity portions.

With such a structure, in any of the electrodes, the heat generated from the heating resistor can be prevented from easily transferring to the outside of the region opposed to the cavity portion. Therefore, the diffusion of heat in the planar direction of the upper substrate via the electrodes can be suppressed more effectively.

The present invention provides a printer including: the thermal head according to the above-mentioned invention; and a pressure mechanism for feeding a thermal recording medium while pressing the thermal recording medium against the heating resistor of the thermal head.

According to the present invention, the thermal head having excellent thermal efficiency is used, and hence the heat generated by the heating resistor can be transferred with high efficiency to the thermal recording medium that is pressed against the heating resistor by the pressure mechanism. Therefore, power consumption during printing on the thermal recording medium can be reduced to extend the battery duration.

The present invention provides a manufacturing method for a thermal head, including: a bonding step of bonding a flat plate-shaped upper substrate in a stacked state to a flat plate-shaped support substrate including a concave portion opened in a surface of the flat plate-shaped support substrate, so as to close the concave portion to form a cavity portion; a heating resistor forming step of forming a heating resistor on a surface of the flat plate-shaped upper substrate, which is bonded to the flat plate-shaped support substrate in the bonding step, at a position opposed to the concave portion; and an electrode forming step of forming a pair of electrodes to be connected to both ends of the heating resistor, respectively, on the flat plate-shaped upper substrate on which the heating resistor is formed in the heating resistor forming step, in which the electrode forming step includes: a first forming step of forming a first layer constituting the pair of electrodes; and a second forming step of forming, at a substantially uniform thickness, a second layer constituting at least one of the pair of electrodes on a surface of the first layer, which is formed in the first forming step, and on a surface of the heating resistor in a region opposed to the cavity portion.

According to the present invention, in the bonding step, the concave portion of the support substrate is closed by the upper substrate, to thereby form the cavity portion at a bonding portion between the support substrate and the upper substrate. The cavity portion functions as a hollow heat insulating layer that blocks heat generated by the heating resistor. Therefore, an amount of heat to be transferred from the heating resistor toward the support substrate can be reduced.

Further, in the second forming step, the second layer having a substantially uniform thickness is simply formed on the surface of the first layer, which is formed in the first forming step, and on the surface of the heating resistor in the region opposed to the cavity portion. In this simple manner, it is possible to form the electrode in which, in the region opposed to the cavity portion, a thin portion having a thickness smaller than other regions by the thickness of the first layer is disposed.

The thin portion of the electrode has thermal conductivity lower than other regions of the electrodes, and hence the heat generated from the heating resistor can be prevented from easily transferring to the outside of the region opposed to the cavity portion. This suppresses diffusion of the heat, which is prevented by the cavity portion from transferring toward the support substrate, in the planar direction of the upper substrate via the electrodes. Therefore, a thermal head with increased printing efficiency can be manufactured with ease.

The present invention provides a manufacturing method for a thermal head, including: a bonding step of bonding a flat plate-shaped upper substrate in a stacked state to a flat plate-shaped support substrate including a concave portion opened in a surface of the flat plate-shaped support substrate, so as to close the concave portion to form a cavity portion; a heating resistor forming step of forming a heating resistor on a surface of the flat plate-shaped upper substrate, which is bonded to the flat plate-shaped support substrate in the bonding step, at a position opposed to the concave portion; and an electrode forming step of forming a pair of electrodes to be connected to both ends of the heating resistor, respectively, on the flat plate-shaped upper substrate on which the heating resistor is formed in the heating resistor forming step, in which the electrode forming step includes: a first forming step of forming the pair of thick electrodes; and a second forming step of forming a thin portion in a region of at least one of the pair of thick electrodes opposed to the cavity portion, which are formed in the first forming step, the thin portion being thinner than other regions of the pair of thick electrodes.

According to the present invention, the thick electrode formed in the first forming step is simply thinned in part in the second forming step. In this simple manner, it is possible to form the electrode in which thermal conductivity in the region opposed to the cavity portion is lower than thermal conductivity in other regions. Further, the formation of the thin portion of the electrode suppresses diffusion of heat from the heating resistor in the planar direction of the upper substrate. Therefore, a thermal head with increased printing efficiency can be manufactured with ease.

The present invention provides the effect that diffusion of heat from the heating resistor in the planar direction of the upper substrate via the electrodes can be suppressed so that printing efficiency may be increased. Further, the present invention provides the effect that the thermal head with increased printing efficiency can be manufactured with ease.

BRIEF DESCRIPTION OF THE DRAWINGS

In the accompanying drawings:

FIGS. 5A to 5G are vertical cross-sectional views illustrating the manufacturing method for a thermal head according to the first embodiment, in which FIG. 5A illustrates a concave portion forming step; FIG. 5B, a bonding step; FIG. 5C, a thinning step; FIG. 5D, a heating resistor forming step; FIG. 5E, a first forming step; FIG. 5F, a second forming step; and FIG. 5G, a protective film forming step;

DETAILED DESCRIPTION OF THE PREFERRED EMBODIMENTS

First Embodiment

Now, a thermal head, a printer, and a manufacturing method for a thermal head according to a first embodiment of the present invention are described below with reference to the accompanying drawings.

Figure 1:
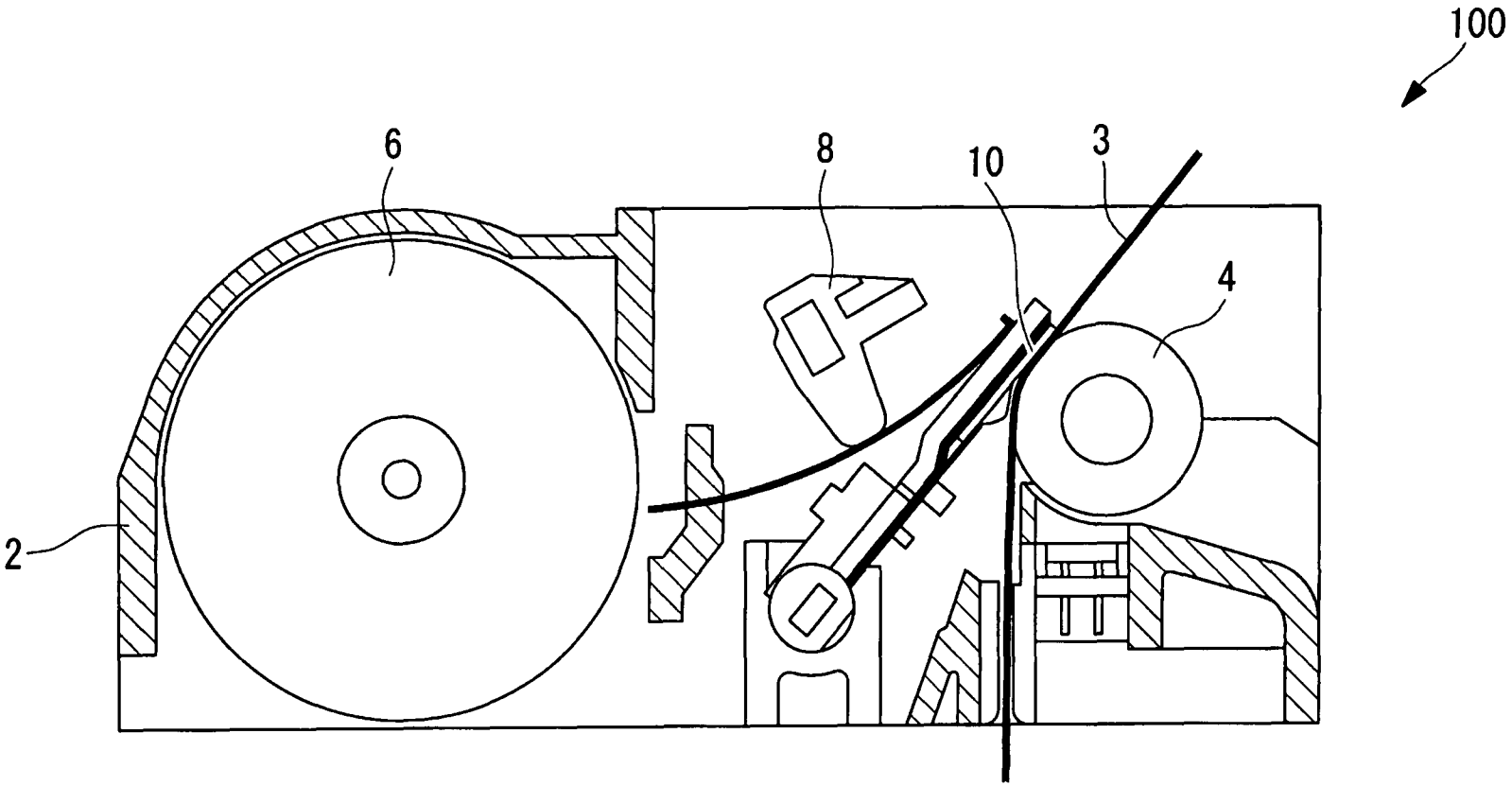
FIG. 1 is a schematic structural view of a thermal printer according to a first embodiment of the present invention.

A thermal printer (printer) 100 according to this embodiment is shown in FIG. 1 and includes a main body frame 2, a platen roller 4 disposed horizontally, a thermal head 10 disposed so as to be opposed to an outer peripheral surface of the platen roller 4, a paper feeding mechanism 6 for feeding an object to be printed, such as thermal paper (thermal recording medium) 3, between the platen roller 4 and the thermal head 10, and a pressure mechanism 8 for pressing the thermal head 10 against the thermal paper 3 with a predetermined pressing force.

Against the platen roller 4, the thermal paper 3 and the thermal head 10 are pressed by the operation of the pressure mechanism 8. Accordingly, a load of the platen roller 4 is applied to the thermal head 10 via the thermal paper 3.

Figure 2:
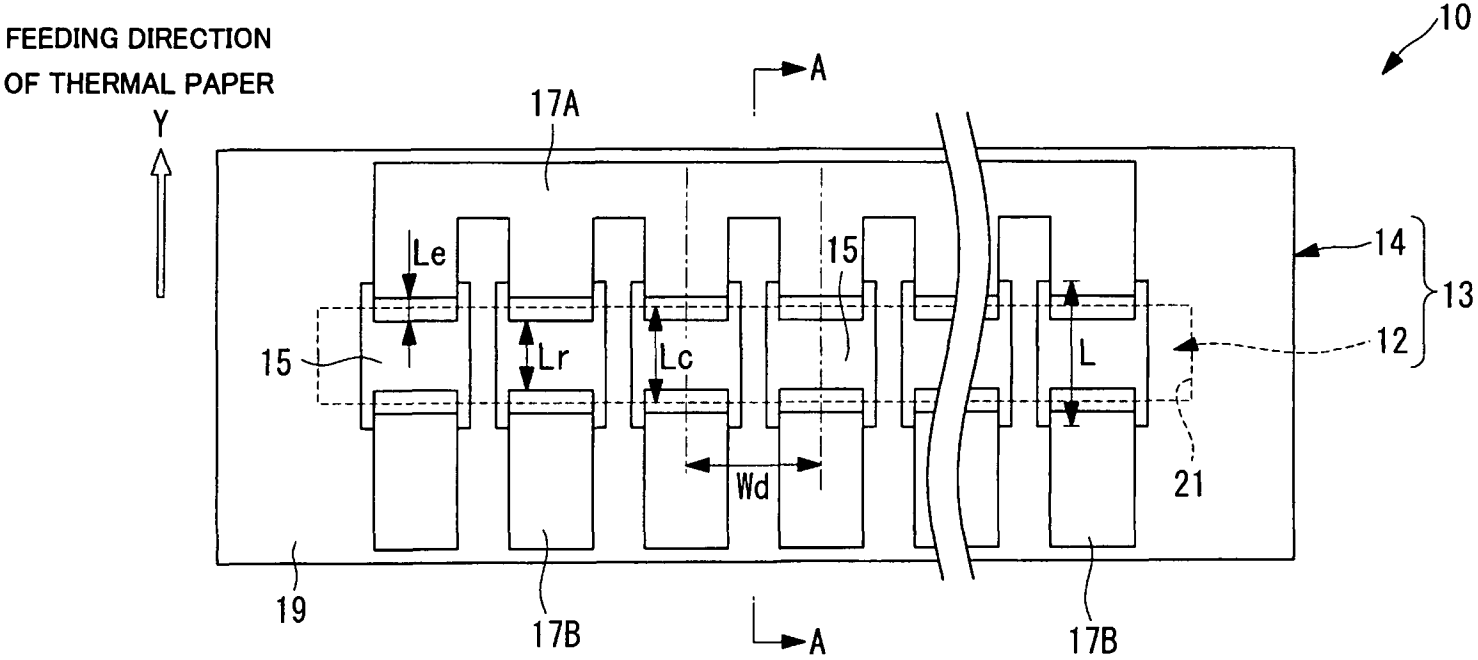
FIG. 2 is a plan view of a thermal head of FIG. 1 viewed in a stacking direction from a protective film side.
Figure 3:
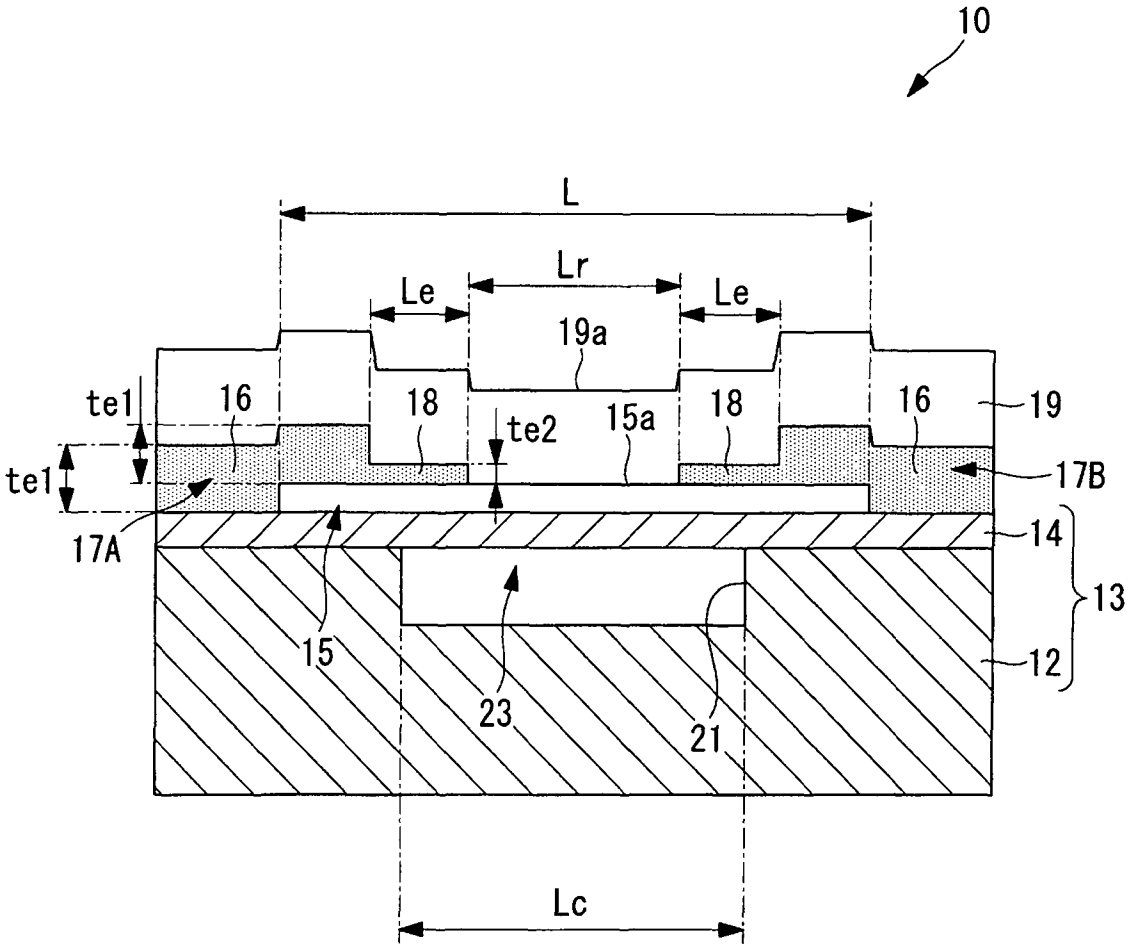
FIG. 3 is a cross-sectional view of the thermal head taken along the line A-A of FIG. 2.

As illustrated in FIGS. 2 and 3, the thermal head 10 includes a substrate main body (stacked substrate) 13, a plurality of heating resistors 15 formed on the substrate main body 13, pairs of electrodes 17A and 17B connected to both ends of the heating resistors 15, and a protective film 19 for covering and protecting, against abrasion and corrosion, the heating resistors 15 and the electrodes 17A and 17B on the substrate main body 13. In the drawings, the arrow Y represents a feeding direction of the thermal paper 3 by the platen roller 4.

The substrate main body 13 is fixed to a heat dissipation plate (not shown) as a plate-shaped member made of a metal such as aluminum, a resin, ceramics, glass, or the like, to thereby dissipate heat via the heat dissipation plate. The substrate main body 13 includes a flat plate-shaped support substrate (first substrate) 12 that is fixed to the heat dissipation plate, and a flat plate-shaped upper substrate (second substrate) 14 that is bonded to a surface of the support substrate 12 in a stacked state.

The support substrate 12 is, for example, a rectangular-shaped glass substrate or ceramic substrate having a thickness approximately ranging from 300 μm to 1 mm. In the support substrate 12, there is formed a concave portion 21 that is opened in a rectangular shape at a bonding surface to the upper substrate 14. The concave portion 21 extends along the longitudinal direction of the support substrate 12, and has a width dimension of, for example, 50 μm to 500 μm.

The upper substrate 14 is, for example, a rectangular-shaped glass substrate having a thickness approximately ranging from 5 μm to 100 μm. The upper substrate 14 is stacked onto the surface of the support substrate 12 so as to close the concave portion 21. For the upper substrate 14, it is desired to use an insulating glass substrate made of the same material as that of the support substrate 12 or a substrate having similar properties. The plurality of heating resistors 15 are provided on the surface of the upper substrate 14 so that the upper substrate 14 functions as a heat storage layer that stores a part of the heat generated by the heating resistors 15.

The heating resistor 15 is made of, for example, a Ta-based or silicide-based material and formed into a rectangular shape. Further, the heating resistor 15 has a dimension that the length in the longitudinal direction thereof is larger than the width dimension of the concave portion 21 of the support substrate 12. The heating resistors 15 are arrayed at predetermined intervals along the longitudinal direction of the upper substrate 14 (longitudinal direction of the concave portion 21 of the support substrate 12), with the longitudinal direction of the heating resistors 15 aligned with the width direction of the upper substrate 14. In other words, the heating resistors 15 are each provided so as to straddle the concave portion 21 of the support substrate 12 in its width direction.

The electrodes 17A and 17B include an integrated electrode 17A connected to one ends of all the heating resistors 15 in the longitudinal direction thereof, and a plurality of electrodes 17B individually connected to another end of each of the heating resistors 15. Further, the electrodes 17A and 17B are connected to the heating resistor 15 so as to overlap the surface of the heating resistor 15. The material used for the electrodes 17A and 17B is, for example, aluminum.

Those electrodes 17A and 17B supply the heating resistors 15 with power from an external power source (not shown), thereby allowing the heating resistors 15 to generate heat. The heating resistor 15 has a heating region corresponding to a portion positioned between the electrode 17A and the electrode 17B, that is, a portion positioned substantially directly above the concave portion 21 of the support substrate 12. Hereinafter, the heating region of the heating resistor 15 is referred to as heating portion 15*a*. Further, the surface of the protective film 19 covering the heating portions 15*a* of the heating resistors 15 serves as a printing portion with respect to the thermal paper 3, that is, a head portion 19*a*.

Further, it is desired that the pair of electrodes 17A and 17B be arranged so that a length (heater length) Lr of the heating portion 15*a* extending in the longitudinal direction of the heating resistor 15 may be smaller than a distance (inter-dot distance or dot pitch) Wd between the center positions of adjacent heating resistors 15.

Further, each of the electrodes 17A and 17B has a thin portion 18 at a connecting portion disposed on the surface of the heating resistor 15. The thin portion 18 is thinner than other regions (hereinafter, a portion in the other regions is referred to as thick portion 16). In other words, each of the electrodes 17A and 17B is formed so that a portion disposed on the upper substrate 14 and a part of the connecting portion disposed on the heating resistor 15 may be thick while the rest of the connecting portion disposed on the heating resistor 15 may be thin.

The thick portion 16 has a thickness te1 of, for example, 1 μm to 3 μm. It is desired to set the thickness te1 of the thick portion 16 to fall in such a range that can secure a sufficient electrical resistance so that the electrical resistance of the thick portion 16 may be, for example, approximately 1/10 of the electrical resistance of the heating resistor 15 or lower.

The thin portion 18 is formed from the inside to the outside of the region of the heating resistor 15 opposed to the concave portion 21. A thickness te2 of the thin portion 18 is designed in consideration of, for example, the thickness te1 and the thermal conductivity of the thick portion 16 (the thermal conductivity of A1 is approximately 200 W/(m·° C.)) and the thickness and the thermal conductivity of the upper substrate 14 (the thermal conductivity of commonly-used glass is approximately 1 W/(m·° C.)).

When the thickness te2 of the thin portion 18 is set smaller than the thickness te1 of the thick portion 16, the thermal conductivity of the electrodes 17A and 17B is reduced in part and heat insulating efficiency is increased. However, when the thickness te2 of the thin portion 18 is set too small (for example, when the thickness te2 of the thin portion 18 is set to smaller than 10 nm), the electrical resistances of the electrodes 17A and 17B are increased in part, with the result that a power loss at the thin portion 18 exceeds the amount obtained by increasing the heat insulating efficiency. In addition, the thickness te2 of the thin portion 18 needs to be set considering a thickness that can be obtained by sputtering as a thin film. Therefore, it is desired to set the thickness te2 of the thin portion 18 to, for example, approximately 50 nm to approximately 300 nm.

Further, when a length Le of each of the thin portions 18 extending in the longitudinal direction of the heating resistor 15 is set larger, the thermal conductivity of the electrodes 17A and 17B is reduced in part and the heat insulating efficiency is increased. However, when the length Le of the thin portion 18 is set too large, the electrical resistances of the electrodes 17A and 17B are increased in part, with the result that a power loss at the thin portion 18 exceeds the amount obtained by increasing the heat insulating efficiency. Therefore, it is desired to determine the length Le of the thin portion 18 so that the electrical resistance of each of the thin portions 18 may be 1/10 of the electrical resistance of the heating portion 15*a* or lower.

Further, it is desired that the thin portion 18 be disposed within the width (nip width) in a range in which the platen roller 4 and the head portion 19*a* are brought into contact with each other through the thermal paper 3. Although the nip width is varied depending on the diameter and material of the platen roller 4, it is expected that the nip width generally correspond to a length L in the longitudinal direction of the heating resistor 15 as illustrated in FIG. 3. For example, a width dimension (Lr+2Le) from the thin portion 18 of one electrode 17A to the thin portion 18 of the other electrode 17B is set within approximately 2 mm (within approximately 1 mm from the center position of the heating portion 15*a*). Further, the thick portion 16 provided on the heating resistor 15 is also disposed within the nip width.

Each of the electrodes 17A and 17B having the above-mentioned shapes has a two-stage structure in which a part of the thick portion 16 and the entire thin portion 18 are disposed on the heating resistor 15. In each of the electrodes 17A and 17B, the region disposed at a step portion between the heating resistor 15 and the upper substrate 14 is formed thick (as the thick portion 16). In this manner, disconnection of the electrodes 17A and 17B and an abnormal increase in electrical resistance caused by the step can be prevented to increase the heat insulating efficiency and increase the reliability of the thermal head 10.

In the thermal head 10 structured as described above, the opening of the concave portion 21 of the support substrate 12 is closed by the upper substrate 14, to thereby form a cavity portion 23 directly under the heating portion 15*a* of the heating resistor 15. The cavity portion 23 has a communication structure opposed to all the heating resistors 15. Further, the cavity portion 23 functions as a hollow heat insulating layer for preventing heat generated by the heating portions 15*a* from transferring toward the support substrate 12 from the upper substrate 14.

Figure 4:
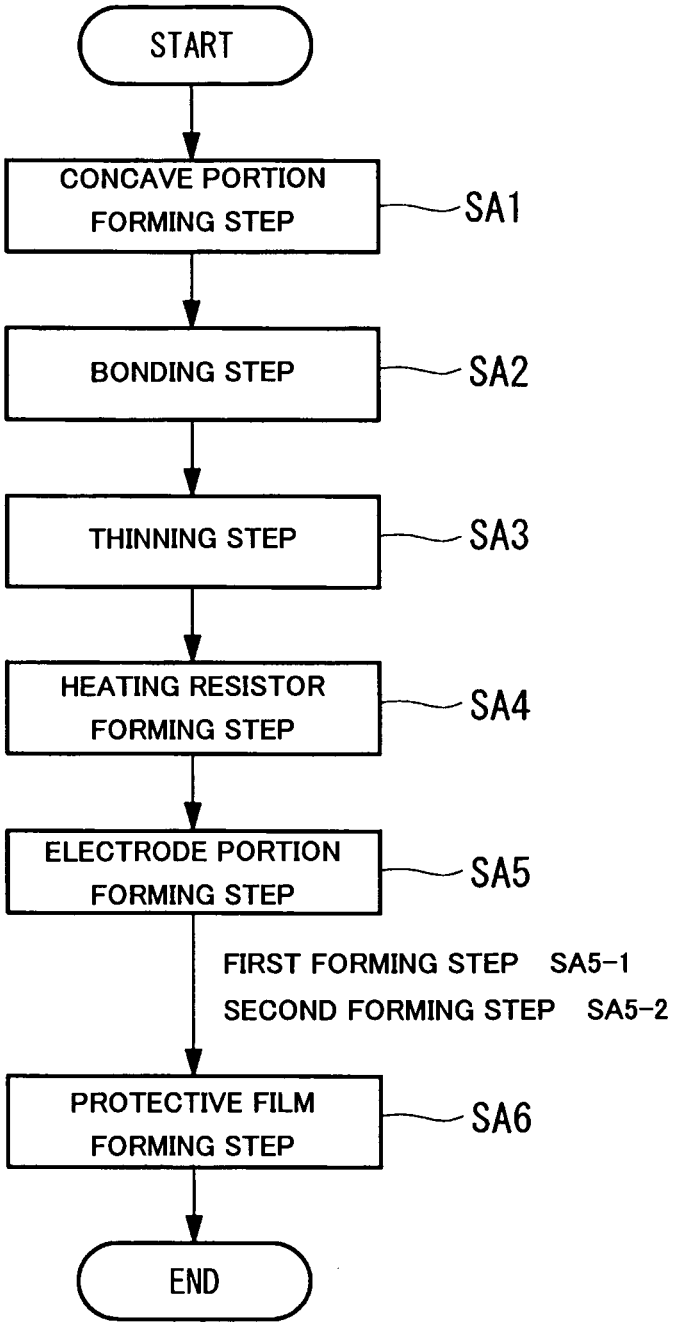
FIG. 4 is a flowchart illustrating a manufacturing method for a thermal head according to the first embodiment of the present invention.

Next, a manufacturing method for the thermal head 10 structured in this way is described with reference to a flowchart of FIG. 4.

The manufacturing method for the thermal head 10 according to this embodiment includes a step of forming the substrate main body 13 and a step of forming the heating resistors 15, the electrodes 17A and 17B, and the protective film 19 on the substrate main body 13.

The step of forming the substrate main body 13 includes a concave portion forming step SA1 of forming the concave portion 21 in the surface of the support substrate 12, a bonding step SA2 of bonding the support substrate 12 and the upper substrate 14 to each other, and a thinning step SA3 of thinning the upper substrate 14. Further, the step of forming the heating resistors 15 and the like includes a heating resistor forming step SA4 of forming the heating resistors 15 on the substrate main body 13, an electrode forming step SA5 of forming the electrodes 17A and 17B, and a protective film forming step SA6 of forming the protective film 19.

Hereinafter, the respective steps are specifically described.

Figure 5A:
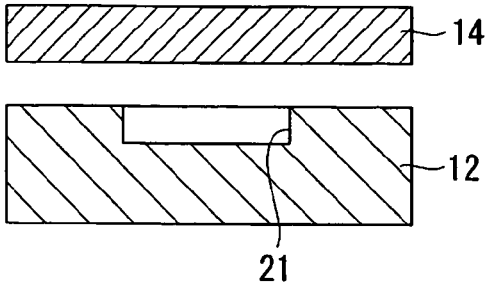

First, in the concave portion forming step SA1, as illustrated in FIG. 5A, the concave portion 21 is formed in the surface of the support substrate 12 in a position to be opposed to the heating resistors 15. The concave portion 21 is formed in the surface of the support substrate 12 by, for example, sandblasting, dry etching, wet etching, or laser machining.

Figure 5B:
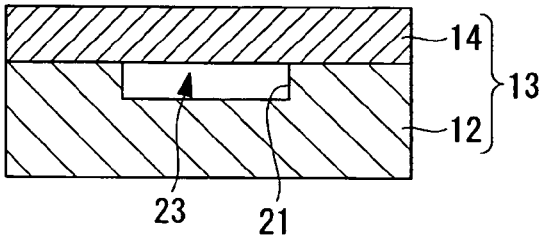

Subsequently, in the bonding step SA2, as illustrated in FIG. 5B, the thin glass (upper substrate) 14 having a thickness of, for example, 100 μm or more is bonded in a stacked state to the surface of the support substrate 12 in which the concave portion 21 is formed. The upper substrate 14 closes the opening of the concave portion 21 to form the cavity portion 23 between the support substrate 12 and the upper substrate 14. The thickness of the cavity portion 23 is defined by the depth of the concave portion 21, which makes it easy to control the thickness of the cavity portion 23 serving as the hollow heat insulating layer.

An example of the bonding method for the support substrate 12 and the upper substrate 14 is direct bonding by thermal fusion. The support substrate 12 and the upper substrate 14 are bonded to each other at room temperature and then subjected to thermal fusion at high temperature. The resultant can be sufficiently high in bonding strength. It is desired that the bonding be performed at the softening temperature or lower in order to prevent deformation of the upper substrate 14.

Figure 5C:
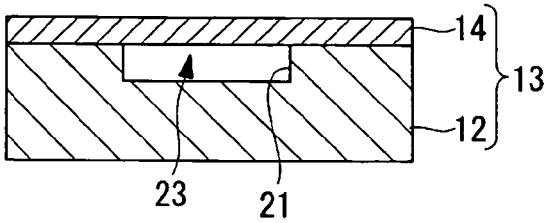

Subsequently, in the thinning step SA3, as illustrated in FIG. 5C, the upper substrate 14 is thinned by etching, polishing, or the like so as to have a desired small thickness. As to the upper substrate 14, it is difficult to manufacture and handle a substrate having a thickness of 100 μm or less, and such a substrate is expensive. Thus, instead of directly bonding an originally thin upper substrate 14 onto the support substrate 12, the upper substrate 14 which is thick enough to be easily manufactured and handled is bonded onto the support substrate 12. After that, the upper substrate 14 is thinned. This enables a very thin upper substrate 14 to be formed on the surface of the support substrate 12 with ease at low cost. In this manner, the substrate main body 13 is formed.

Figure 5D:
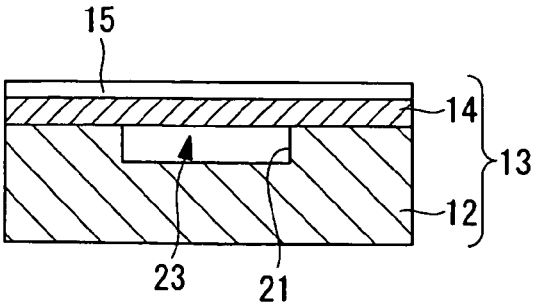

Next, in the heating resistor forming step SA4, as illustrated in FIG. 5D, a thin film of the material of the heating resistors is formed on the upper substrate 14 of the substrate main body 13 by a thin film formation method such as sputtering, chemical vapor deposition (CVD), or deposition. Then, the thin film of the material of the heating resistors is molded by lift-off, etching, or the like.

Figure 5E:
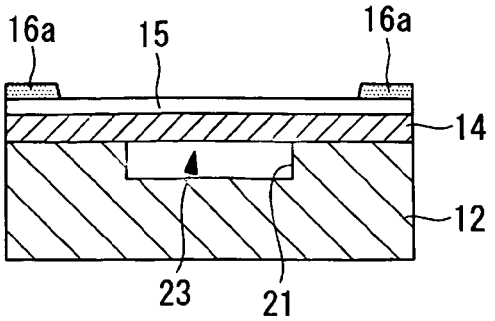
Figure 5F:
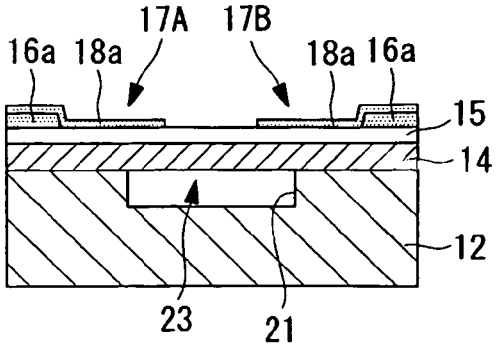

The electrode forming step SA5 includes a first forming step SA5-1 of forming, as illustrated in FIG. 5E, a lower layer (hereinafter, referred to as first layer 16*a*) of the thick portion 16 of each of the electrodes 17A and 17B, and a second forming step SA5-2 of forming, as illustrated in FIG. 5F, a second layer 18*a* on top of the first layer 16*a*, which is formed in the first forming step SA5-1.

In the first forming step SA5-1, the first layers 16*a* are formed from both end portions of the heating resistor 15 in the longitudinal direction thereof to the upper substrate 14 and outside the region opposed to the cavity portion 23. The first layer 16*a* is formed in a manner that a film of a wiring material such as Al, Al—Si, Au, Ag, Cu, or Pt is deposited by sputtering, vapor deposition, or the like. Then, the film thus obtained is formed by lift-off or etching, or alternatively the wiring material is baked after screen-printing, to thereby form the first layer 16*a* having a desired shape.

Subsequently, in the second forming step SA5-2, the second layers 18*a* are formed at a substantially uniform thickness on the surface of the heating resistor 15 from inside the region opposed to the cavity portion 23 and over the first layers 16*a*. The second layer 18*a* is formed in a manner that a film of the same material as that of the first layer 16*a* is deposited by sputtering, vapor deposition, or the like. Then, the film thus obtained is formed by lift-off or etching, or alternatively the wiring material is baked after screen-printing, to thereby form the second layer 18*a* having a desired shape. The second layer 18*a* having a substantially uniform thickness is formed on each of the surface of the first layer 16*a* and the surface of the heating resistor 15. In this manner, it is possible to form the electrodes 17A and 17B, each of which has a stepped shape including the thick portion 16 and the thin portion 18 which is thinner than the thick portion 16 by the thickness of the first layer 16*a*.

Figure 5G:
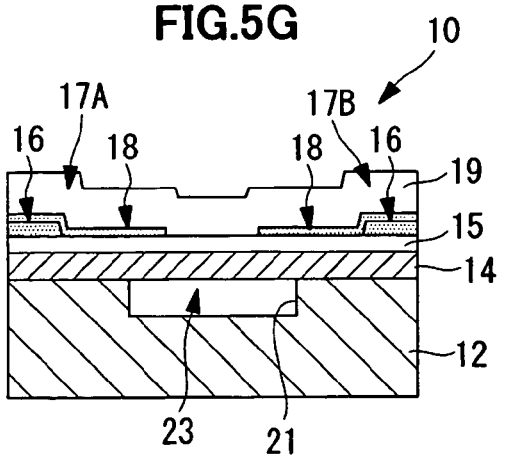

Subsequently, in the protective film forming step SA6, as illustrated in FIG. 5G, the protective film 19 is formed so as to cover the heating resistor 15 and the electrodes 17A and 17B formed on the upper substrate 14. The protective film 19 is formed in a manner that a film of a protective film material such as $SiO_2$, $Ta_2O_5$, SiAlON, $Si_3N_4$, or diamond-like carbon is deposited on the upper substrate 14 by sputtering, ion plating, CVD, or the like.

Through the above-mentioned steps, the thermal head 10 is completed, in which the substrate main body 13 has the cavity portion 23 at the bonding portion between the support substrate 12 and the upper substrate 14, and the electrodes 17A and 17B each have the thin portion 18 in the region of the heating resistor 15 opposed to the cavity portion 23.

Hereinafter, operations of the thermal head 10 structured in this way and the thermal printer 100 are described.

In printing on the thermal paper 3 using the thermal printer 100 according to this embodiment, first, a voltage is selectively applied to the individual electrodes 17B of the thermal head 10. Then, a current flows through the heating resistors 15 which are connected to the selected electrodes 17B and the electrode 17A opposed thereto, to thereby allow the heating portions 15*a* to generate heat.

Subsequently, the pressure mechanism 8 is operated to press the thermal head 10 against the thermal paper 3 being fed by the platen roller 4. The platen roller 4 rotates about an axis parallel to the array direction of the heating resistors 15, to thereby feed the thermal paper 3 toward the Y direction orthogonal to the array direction of the heating resistors 15. Against the thermal paper 3, the head portion 19*a* is pressed, so that color is developed on the thermal paper 3, to thereby perform printing.

In this case, in the thermal head 10, the cavity portion 23 of the substrate main body 13 functions as the hollow heat insulating layer, and hence among an amount of heat generated by the heating resistor 15*a*, an amount of heat transferring toward the support substrate 12 via the upper substrate 14 can be reduced. On this occasion, the heat generated by the heating resistor 15 diffuses also in the planar direction of the upper substrate 14 via the electrodes 17A and 17B. Therefore, the length Le of the thin portion 18 of each of the electrodes 17A and 17B is a parameter affecting the heating efficiency.

In the thermal head 10 according to this embodiment, the thin portion 18 is disposed inside and outside the region of the surface of the heating resistor 15 opposed to the cavity portion 23, and hence each of the electrodes 17A and 17B has a region of low thermal conductivity which extends from the inside to the outside of the region opposed to the cavity portion 23. Accordingly, the heat generated from the heating resistor 15 can be prevented from easily transferring to the outside of the region opposed to the cavity portion 23, to thereby reduce the diffusion of heat in the planar direction of the upper substrate 14. Further, high heat insulating effect by the cavity portion 23 can be fully utilized.

Further, in a region of the upper substrate 14 outside the region opposed to the cavity portion 23, a heat flux toward the support substrate 12 (in the thickness direction of the substrate main body 13) is large. Therefore, as compared to the inside of the region of the upper substrate 14 opposed to the cavity portion 23, there is less influence of the diffusion of heat in the planar direction of the upper substrate 14 via the electrodes 17A and 17B. By adjusting the length Le of the thin portions 18 so that the electrical resistance of each of the thin portions 18 may become 1/10 of the electrical resistance of the heating portion 15*a* or lower, most of the power to be supplied to the heating resistor 15 can be effectively utilized for heat generation at the heating portion 15*a*, to thereby increase printing efficiency.

Further, in any of the electrodes 17A and 17B, the hear generated from the heating resistor 15 is prevented from easily transferring to the outside of the region opposed to the cavity portion 23, and hence the diffusion of heat in the planar direction of the upper substrate 14 via the electrodes 17A and 17B can be suppressed more effectively. Still further, the formation of the thin portions 18 allows a small step to be formed between the heating resistor 15 and the electrodes 17A and 17B, and hence an air gap due to the step formed between the surface of the protective film 19 and the thermal paper 3 can be reduced as well. This can increase heat transfer efficiency toward the thermal paper 3.

Meanwhile, there are two available printing methods, that is, one is a single-step printing method in which printing for one dot line is performed in a single step, and the other is a multi-step printing method in which printing for one dot line is performed in a plurality of steps. In the case of the single-step printing method, the heater length Lr of the heating portion of the heating resistor is designed to the same or larger length of the inter-dot distance (dot pitch) Wd. On the other hand, in the case of the multi-step printing method, the heater length Lr of the heating portion is designed to be smaller than the inter-dot distance Wd.

Further, a thermal head employed in the multi-step printing method has a short heater length Lr of the heating portion, and hence the effective volume of the upper substrate positioned directly under the heating portion is reduced and an effective heat capacity C of the upper substrate is reduced. A temperature rise $\Delta T$ and the heat capacity C for one pulse has a relationship of $\Delta T \propto 1/C$. Therefore, in the multi-step printing method, a large temperature rise $\Delta T$ can be obtained. Further, response speed of the heating portion has an inverse relationship ($\tau \propto 1/\tau$) with a time constant $\tau = C \times G$, which is determined by the heat capacity C and a thermal conductivity G from the heating portion toward the support substrate. Therefore, the multi-step printing method has an advantage of high-speed response because the heat capacity C is reduced.

However, when the length of the heating portion is shortened, the ratio of the area covered by the electrodes with respect to the whole area of the cavity portion of the substrate main body is increased. In this case, dissipation of heat in the planar direction of the upper substrate via the electrodes becomes large to increase the thermal conductivity G. Therefore, if the multi-step printing method is used without forming the thin portions in the electrodes, the heat insulating effect by the cavity portion cannot be utilized effectively. Further, performance (heat storage performance) of storing input energy in the heating portion is inversely proportional to the time constant $\tau$. Therefore, if the multi-step printing method is used without forming the thin portions in the electrodes, the heat storage effect is reduced. As a result, the thermal head which has a short heater length Lr of the heating portion to be employed in the multi-step printing method suffers a problem that high heating effect cannot be obtained.

In the thermal head 10 according to this embodiment, even if the heater length Lr of the heating portion 15*a* is shortened, the thin portions 18 can suppress diffusion of heat in the planar direction of the upper substrate 14 via the electrodes 17A and 17B, respectively, to thereby suppress an increase in the thermal conductivity G. Therefore, when the heater length Lr of the heating portion 15*a* is shortened to be smaller than the inter-dot distance (dot pitch) Wd ($Lc<2Le+Lr$, $Lr<Wd$), it is possible to effectively take advantage of an effective reduction in heat capacity of the upper substrate 14, which is inherent in the thermal head 10 having a short heater length Lr of the heating portion 15*a*. In this manner, high heating efficiency and high-speed response can be achieved at the same time.

As described above, according to the thermal head 10 of this embodiment, the thickness of each of the electrodes 17A and 17B disposed above the cavity portion 23 is reduced in part so as to reduce the thermal conductivity thereof, and hence diffusion of heat in the planar direction of the upper substrate 14 via the electrodes 17A and 17B can be suppressed. This allows the heat generated from the heating portion 15*a* to effectively transfer to the head portion 19*a* so that printing efficiency may be increased.

Further, according to the thermal printer 100 of this embodiment, the thermal head 10 as described above is provided, and hence power consumption during printing on the thermal recording medium may be reduced to extend the battery duration. Further, according to the manufacturing method for a thermal head according to this embodiment, the thermal head 10 as described above can be manufactured with ease.

Figure 6:
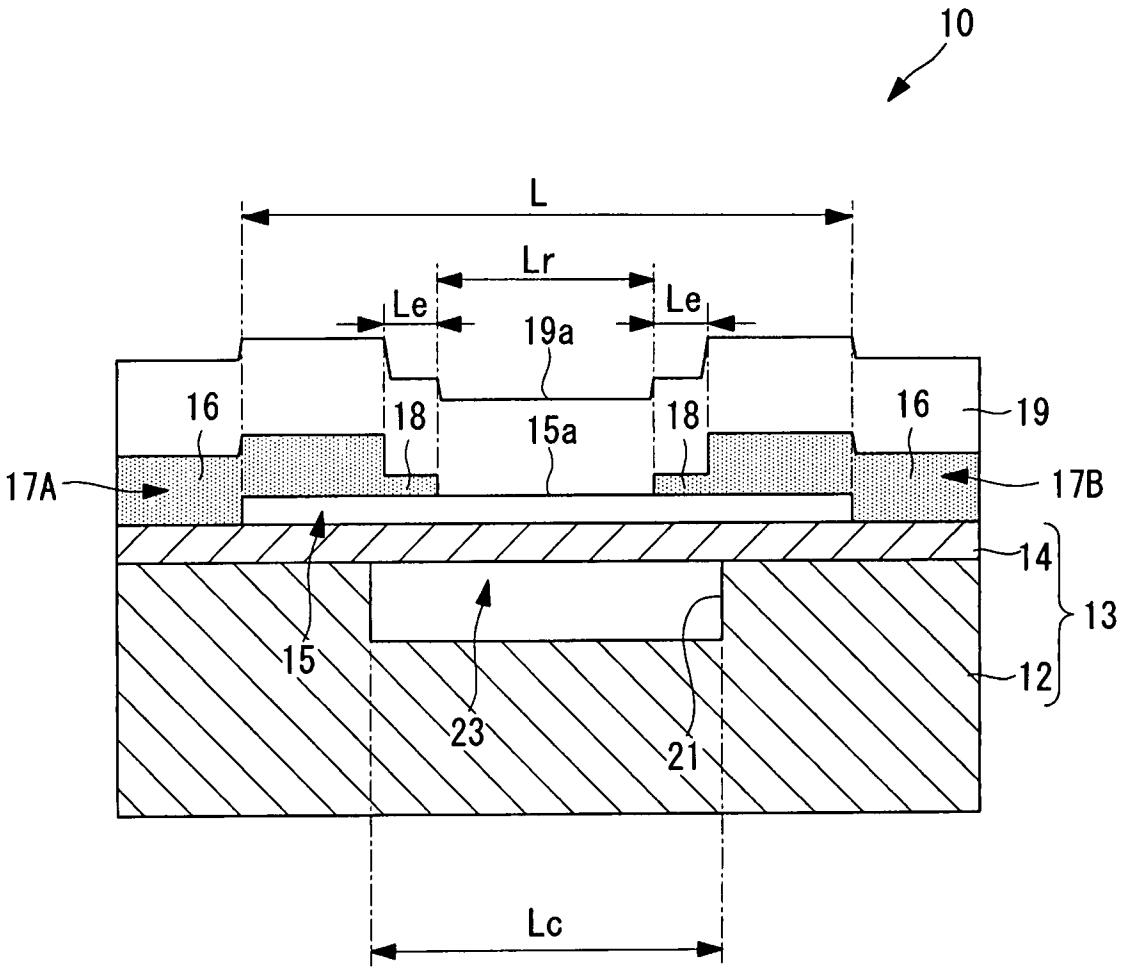
FIG. 6 is a vertical cross-sectional view illustrating a thermal head according to a modified example of the first embodiment of the present invention.
Figure 7:
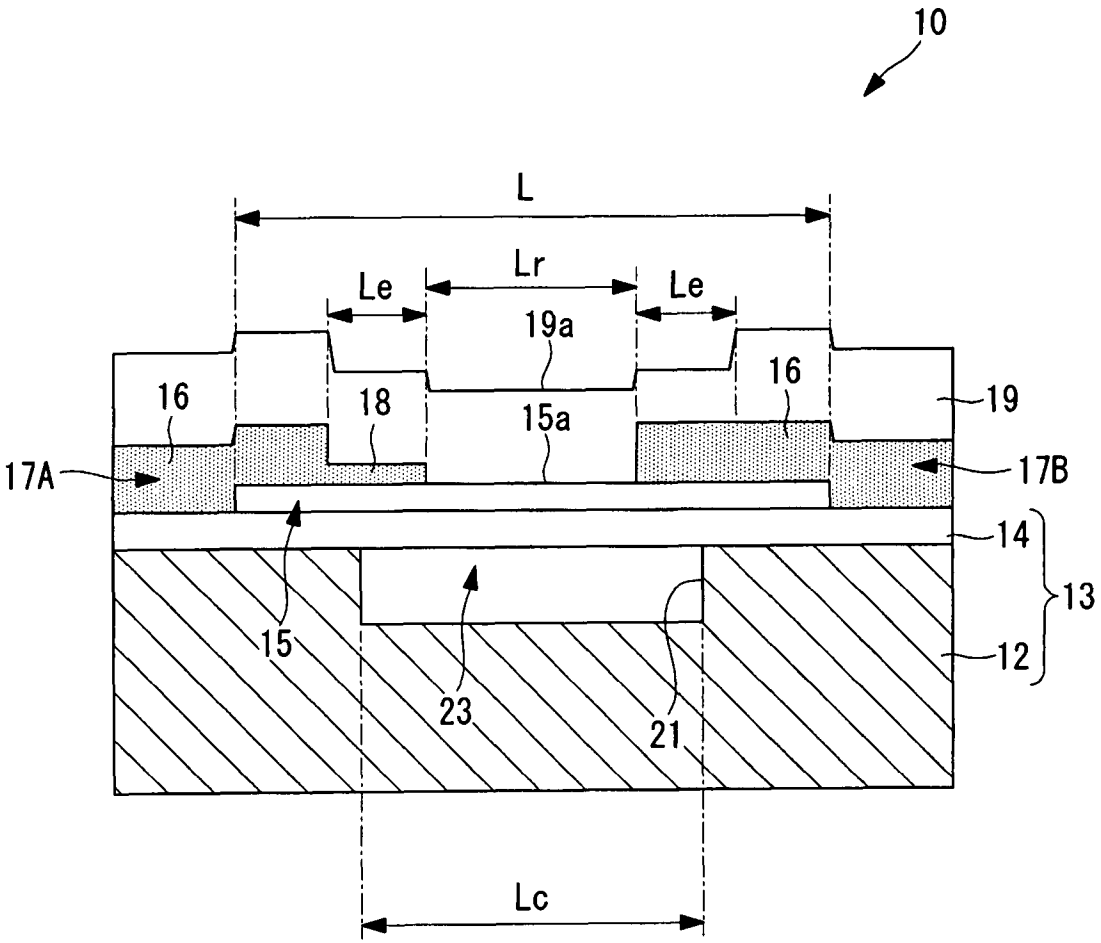
FIG. 7 is a vertical cross-sectional view illustrating a thermal head according to another modified example of the first embodiment of the present invention.

In this embodiment, the thin portion 18 of each of the electrodes 17A and 17B is disposed from the inside to the outside of the region of the heating resistor 15 opposed to the cavity portion 23. Alternatively, for example, as illustrated in FIG. 6, each of the electrodes 17A and 17B may include a thin portion 18 only inside the region of the heating resistor 15 opposed to the cavity portion 23. Still alternatively, for example, as illustrated in FIG. 7, the thin portion 18 may be formed in only one of the electrodes 17A and 17B, and the other electrode may be formed only of the thick portion 16.

Figure 8:
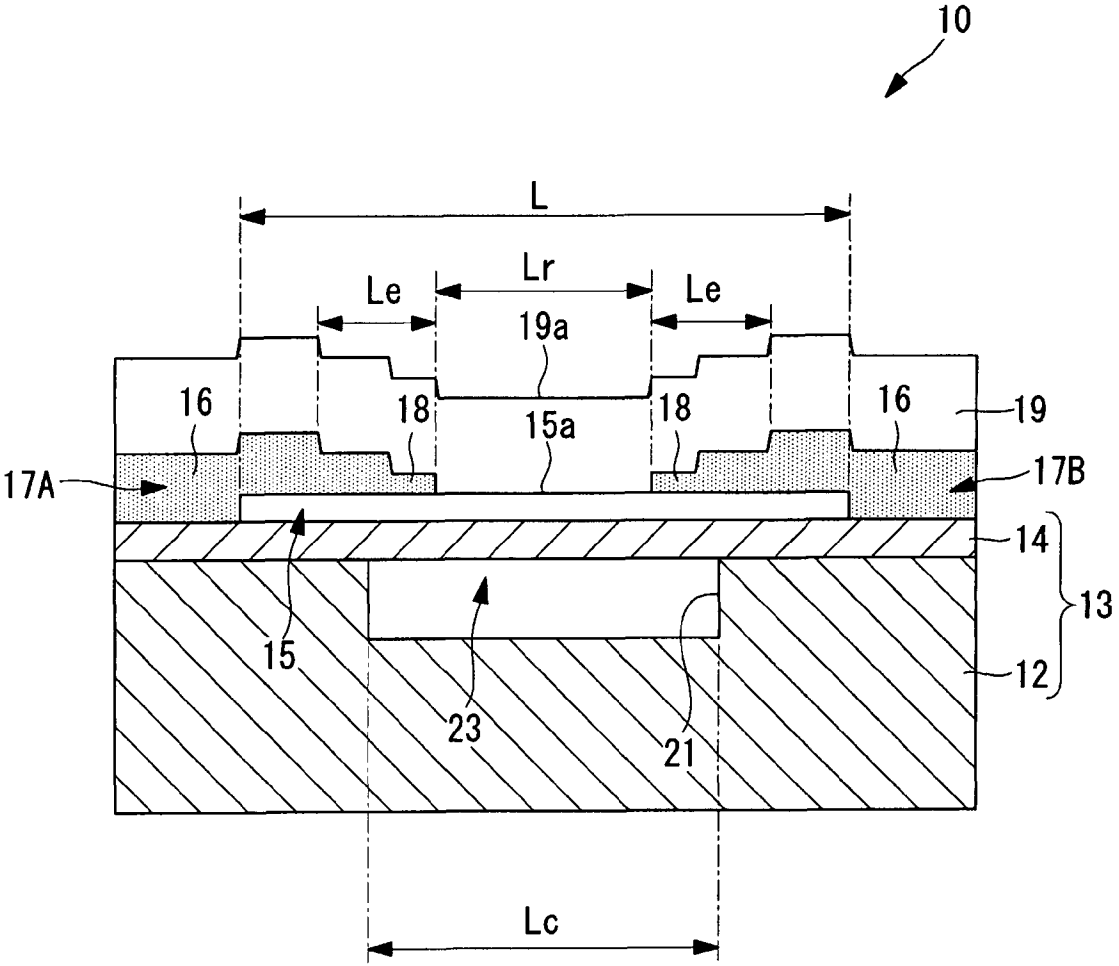
FIG. 8 is a vertical cross-sectional view illustrating a thermal head according to another modified example of the first embodiment of the present invention.
Figure 9:
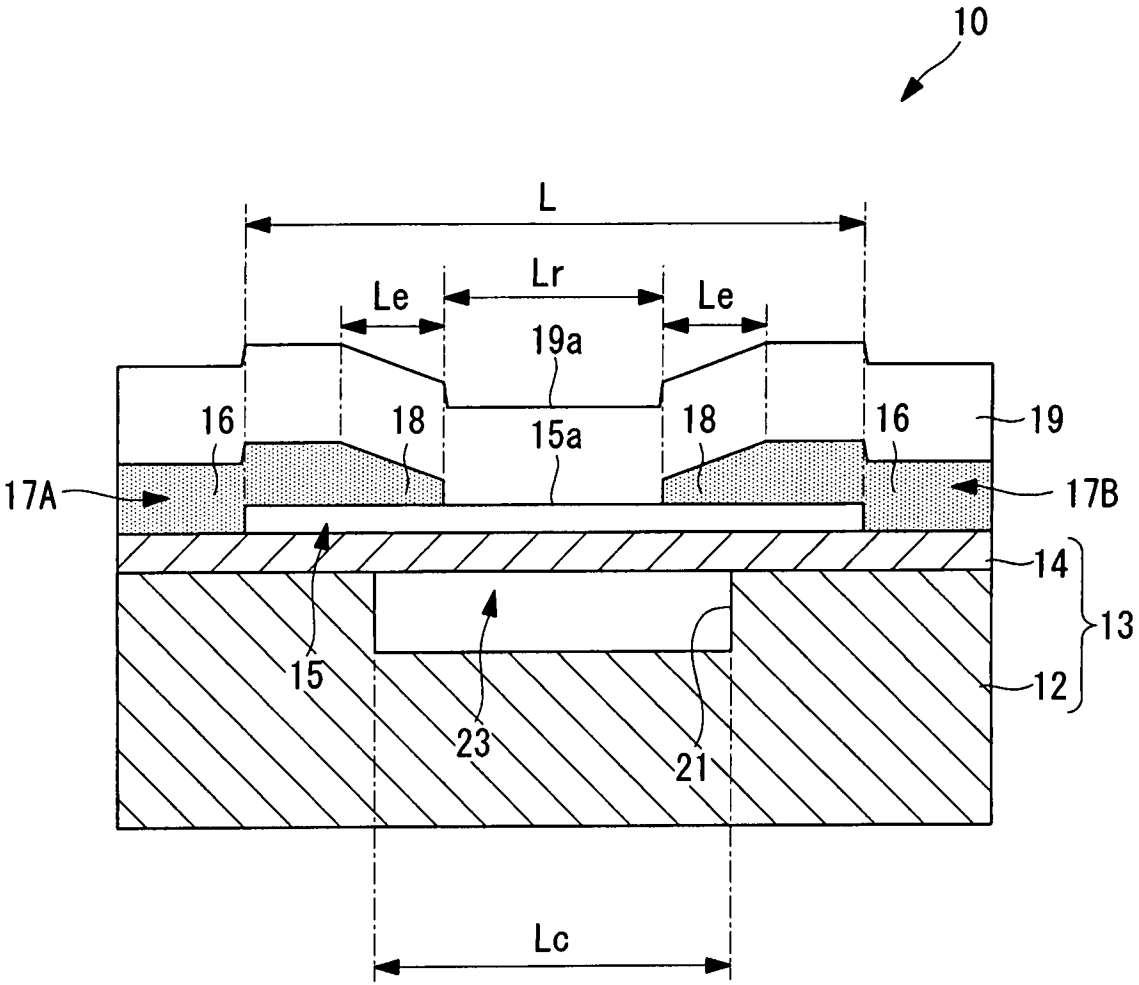
FIG. 9 is a vertical cross-sectional view illustrating a thermal head according to another modified example of the first embodiment of the present invention.

Further, it is only necessary that the electrodes 17A and 17B each have the thin portion 18 inside the region opposed to the cavity portion 23. For example, as illustrated in FIG. 8, the electrodes 17A and 17B may each have a stepped shape with three steps or more in which the thickness of the electrode 17A or 17B is reduced in stages from the thick portion 16 side. Alternatively, as illustrated in FIG. 9, the electrodes 17A and 17B may each have a thin portion 18 having a shape which is inclined so that the thickness of the connecting portion of the electrode 17A or 17B may be reduced gradually toward the distal end thereof.

Even when the shape of the thin portion 18 is modified as illustrated in FIGS. 6 to 9, similarly to the first embodiment, the thermal conductivity of the electrodes 17A and 17B above the cavity portion 23 is reduced so as to suppress diffusion of heat generated from the heating portion 15*a* in the planar direction of the upper substrate 14.

Further, the upper substrate 14 having a thickness of 100 μm or larger is used in the above. As an alternative thereto, in the bonding step SA2, an originally thin glass (upper substrate 14) having a thickness ranging from 5 μm to 100 μm may be bonded in a stacked state to the surface of the support substrate 12 in which the cavity portion 23 is formed. This can omit the thinning step SA3 and shortens a manufacturing time.

Further, this embodiment can be modified as follows.

Figure 10A:
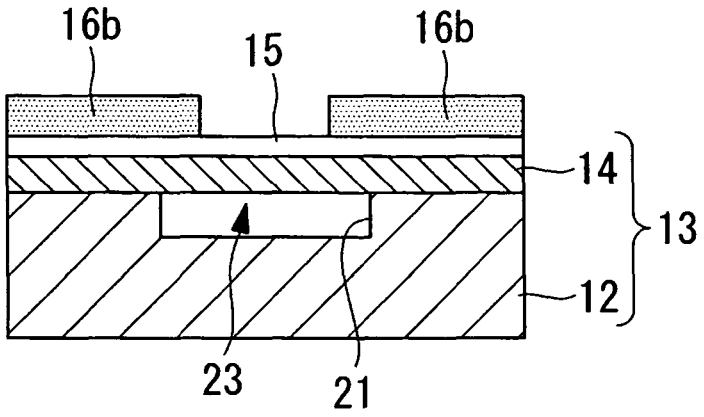
FIGS. 10A and 10B are vertical cross-sectional views illustrating a first forming step and a second forming step, respectively, of a manufacturing method for a thermal head according to a modified example of the first embodiment of the present invention.
Figure 10B:
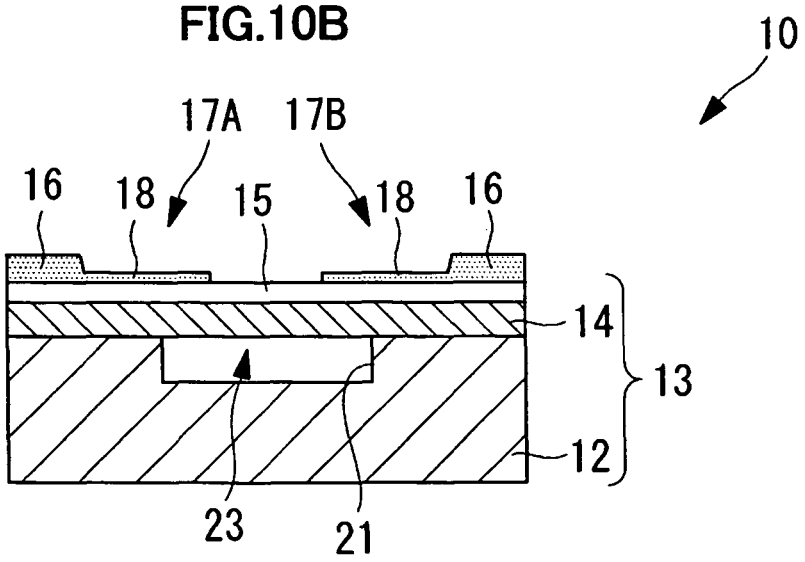

For example, in the electrode forming step SA5 of this embodiment, the first layer 16*a* is formed in the first forming step SA5-1 and the second layer 18*a* is formed in the second forming step SA5-2. Alternatively, however, as illustrated in FIG. 10A, in the first forming step SA5-1, a preliminary electrode 16*b* having a substantially uniform thickness approximately ranging from 1 μm to 3 μm as a whole, which is the same thickness of the thick portion 16, may be formed. Then, as illustrated in FIG. 10B, in the second forming step SA5-2, the thin portion 18 may be formed in a region of the preliminary electrode 16*b* opposed to the cavity portion 23.

In this case, in the first forming step SA5-1 according to this modified example, the same method as the method of forming the above-mentioned first layer 16*a* may be employed to form the preliminary electrode 16*b* into an electrode pattern having a substantially uniform thickness. Further, in the second forming step SA5-2, for example, etching may be used to thin a part of the preliminary electrode 16*b* provided above the cavity portion 23.

In this way, it is possible to form the electrodes 17A and 17B in which thermal conductivity in the region opposed to the cavity portion 23 is lower than thermal conductivity in other regions. Further, the formation of the thin portion 18 suppresses diffusion of heat from the heating resistor 15 in the planar direction of the upper substrate 14. Therefore, the thermal head 10 with increased printing efficiency can be manufactured with ease.

Second Embodiment

Next, a thermal head, a printer, and a manufacturing method for a thermal head according to a second embodiment of the present invention are described.

Figure 11:
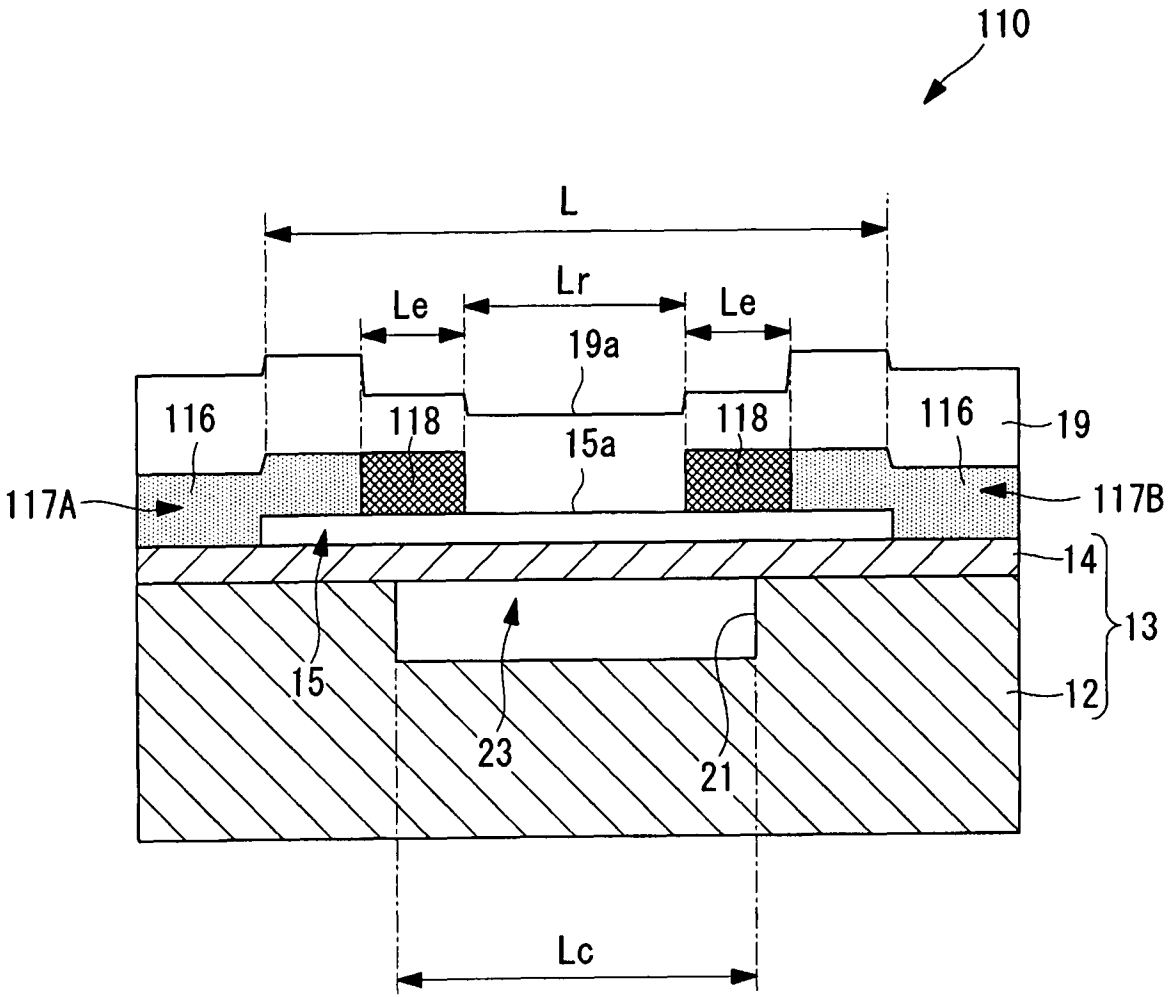
FIG. 11 is a vertical cross-sectional view of a thermal head according to a second embodiment of the present invention.

As illustrated in FIG. 11, a thermal head 110 according to this embodiment is different from the thermal head 10 according to the first embodiment in that electrodes 117A and 117B each include a low thermal conductivity portion 118, which is provided in a region opposed to the cavity portion 23 and made of a material having thermal conductivity lower than other regions and having an electrical resistance lower than that of the heating resistor 15. Hereinafter, parts common to the thermal head 10, the thermal printer 100, and the manufacturing method for a thermal head according to the first embodiment are denoted by the same reference symbols and the descriptions thereof are omitted.

The electrodes 117A and 117B have a substantially uniform thickness as a whole. In each of the electrodes 117A and 117B, a portion disposed on the upper substrate 14 and a part of a connecting portion disposed on the heating resistor 15 are formed of a material of A1 (thermal conductivity: 223 W/(m·K), electrical resistance: 26.6 nΩ·m) (hereinafter, this portion is referred to as "normal electrode 116"), and the remaining part of the connecting portion disposed on the heating resistor 15 is the low thermal conductivity portion 118.

The low thermal conductivity portions 118 are formed of such a material as Pd (thermal conductivity: 71.4 W/(m·K), electrical resistance: 103 nΩ·m), Pt (thermal conductivity: 71.4 W/(m·K), electrical resistance: 106 nΩ·m), Mo (thermal conductivity: 147 W/(m·K), electrical resistance: 57.8 nΩ·m), Nb (thermal conductivity: 52.5 W/(m·K), electrical resistance: 146 nΩ·m), Ta (thermal conductivity: 54.6 W/(m·K), electrical resistance: 136 nΩ·m), Ti (thermal conductivity 17.1 W/(m·K), electrical resistance: 420 Ω·m), V (thermal conductivity: 31.1 W/(m·K), electrical resistance: 248 Ω·m), or Zr (thermal conductivity: 22.7 W/(m·K), electrical resistance: 420 nΩ·m).

The low thermal conductivity portions 118 are each disposed on the heating resistor 15 from the inside to the outside of the region opposed to the cavity portion 23. Further, it is desired to determine a length Le of the heating resistor 15 in the low thermal conductivity portion 118 so that the electrical resistance of each of the low thermal conductivity portions 118 may be 1/10 of the electrical resistance of the heating portion 15*a* or lower. It is also desired to arrange the pair of electrodes 117A and 117B so that a heater length Lr of the heating resistor 15 may be shorter than the distance (inter-dot distance or dot pitch) Wd between the center positions of adjacent heating resistors 15. This arrangement provides the same effect as that of the thermal head 10 according to the first embodiment. In general, a material of low thermal conductivity has high electrical resistivity. Therefore, the length Le of the low thermal conductivity portion 118 is a parameter affecting the heating efficiency.

In the thermal head 110 according to this embodiment, the low thermal conductivity portion 118 of each of the electrodes 117A and 117B, which is disposed above the cavity portion 23, has an electrical resistance lower than that of the heating resistor 15. Therefore, sufficient power may be supplied to the heating resistor 15. Further, thermal conductivity of the low thermal conductivity portions 118 is lower than that of the normal electrodes 116, and hence heat generated from the heating resistor 15 can be prevented from easily transferring to the outside of the region opposed to the cavity portion 23.

This suppresses the diffusion of the heat, which is prevented by the cavity portion 23 from transferring toward the support substrate 12, in the planar direction of the upper substrate 14 via the electrodes 117A and 117B. Therefore, the heat generated by the heating portion 15*a* can be transferred to the head portion 19*a* to increase printing efficiency, to thereby reduce power consumption.

Hereinabove, the embodiments of the present invention have been described in detail with reference to the accompanying drawings. However, specific structures of the present invention are not limited to the embodiments and encompass design modifications and the like without departing from the gist of the present invention. For example, the present invention is not particularly limited to one of the above-mentioned embodiments and modified examples, and may be applied to an embodiment in an appropriate combination of the embodiments and modified examples.

FIG. 2

Y FEEDING DIRECTION OF THERMAL PAPER

FIG. 4

SA1 CONCAVE PORTION FORMING STEP
SA2 BONDING STEP
SA3 THINNING STEP
SA4 HEATING RESISTOR FORMING STEP
SA5 ELECTRODE FORMING STEP
SA5-1 FIRST FORMING STEP
SA5-2 SECOND FORMING STEP
SA6 PROTECTIVE FILM FORMING STEP

What is claimed is:

1. A thermal head, comprising:

a substrate main body having a flat plate-shaped support substrate and a flat plate-shaped upper substrate which are bonded to each other in a stacked state;

a rectangular-shaped heating resistor formed on a surface of the flat plate-shaped upper substrate; and a pair of electrodes connected to both ends of the rectangular-shaped heating resistor, respectively, for supplying power to the rectangular-shaped heating resistor;

wherein the substrate main body has a cavity portion in a region opposed to the rectangular-shaped heating resistor at a bonding portion between the flat plate-shaped support substrate and the flat plate-shaped upper substrate; and wherein at least one of the pair of electrodes includes a low thermal conductivity portion in a region opposed to the cavity portion, the low thermal conductivity portion being made of a material having a thermal conductivity lower than a thermal conductivity in other regions of the pair of electrodes and having an electrical resistance lower than an electrical resistance of the rectangular-shaped heating resistor.

2. A thermal head according to claim 1; wherein the low thermal conductivity portion extends to an outside of the region opposed to the cavity portion.

3. A thermal head according to claim 2; wherein both of the pair of electrodes include the low thermal conductivity portions.

4. A thermal head according to claim 1; wherein both of the pair of electrodes include the low thermal conductivity portions.

5. A printer, comprising:

a thermal head according to claim 1; and a pressure mechanism for feeding a thermal recording medium while pressing the thermal recording medium against the heating resistor of the thermal head.

6. A thermal head according to claim 1; further comprising a protective film covering the rectangular-shaped heating resistor and the pair of electrodes.

7. A manufacturing method for a thermal head, comprising:

a bonding step of bonding a flat plate-shaped upper substrate in a stacked state to a flat plate-shaped support substrate having a concave portion opened in a surface of the flat plate-shaped support substrate so as to close the concave portion to form a cavity portion;

a heating resistor forming step of forming a heating resistor on a surface of the flat plate-shaped upper substrate, which is bonded to the flat plate-shaped support substrate in the bonding step, at a position opposed to the concave portion; and an electrode forming step of forming a pair of electrodes for connection to both ends of the heating resistor, respectively, on the flat plate-shaped upper substrate on which the heating resistor is formed in the heating resistor forming step;

wherein the electrode forming step comprises:

a first forming step of forming a pair of thick electrodes; and a second forming step of forming a thin portion in a region of at least one of the pair of thick electrodes opposed to the cavity portion, which is formed in the first forming step, the thin portion being thinner than other regions of the pair of thick electrodes.

8. A thermal head comprising:

a first substrate having a concave portion;

a second substrate mounted on the first substrate and covering the concave portion to form with the first substrate a cavity portion;

a heating resistor provided on a surface of the second substrate; and a pair of electrodes connected to the heating resistor for supplying power to the heating resistor, at least one of the pair of electrodes having a low thermal conductivity portion in a region opposed to the cavity portion, the low thermal conductivity portion being made of a material having a thermal conductivity lower than a thermal conductivity in other regions of the pair of electrodes and having an electrical resistance lower than an electrical resistance of the heating resistor.

9. A thermal head according to claim 8; wherein the low thermal conductivity portion extends to an outside of the region opposed to the cavity portion.

10. A thermal head according to claim 9; wherein both of the pair of electrodes include the low thermal conductivity portions.

11. A thermal head according to claim 8; wherein both of the pair of electrodes include the low thermal conductivity portions.

12. A thermal head according to claim 8; further comprising a protective film covering the heating resistor and the pair of electrodes.

13. A thermal head according to claim 8; wherein the heating resistor is provided on the surface of the second substrate so that the second substrate is configured as a heat storage layer that stores an amount of heat generated by the heating resistor.

14. A thermal head according to claim 8; wherein the heating resistor comprises a plurality of heating resistors arrayed at predetermined intervals along a longitudinal direction of the second substrate.

15. A thermal head according to claim 14; wherein the pair of electrodes comprises a plurality of pairs of electrodes connected to respective ones of the plurality of heating resistors.

16. A thermal head according to claim 8; wherein the heating resistor comprises a plurality of heating resistors arrayed at predetermined intervals along a longitudinal direction of the concave portion of the first substrate.

17. A thermal head according to claim 16; wherein the pair of electrodes comprises a plurality of pairs of electrodes connected to respective ones of the plurality of heating resistors.

18. A printer comprising:

a thermal head according to claim 8; and a pressure mechanism for feeding a thermal recording medium while pressing the thermal recording medium against the heating resistor of the thermal head.

* * * * *